US007982184B2

(12) United States Patent
Sudakov

(10) Patent No.: US 7,982,184 B2
(45) Date of Patent: Jul. 19, 2011

(54) MULTI-REFLECTING TIME-OF-FLIGHT MASS ANALYSER AND A TIME-OF-FLIGHT MASS SPECTROMETER INCLUDING THE MASS ANALYSER

(75) Inventor: Michael Sudakov, St. Petersburg (RU)

(73) Assignee: Shimadzu Corporation, Tokyo (JP)

( * ) Notice: Subject to any disclaimer, the term of this patent is extended or adjusted under 35 U.S.C. 154(b) by 75 days.

(21) Appl. No.: 12/445,231

(22) PCT Filed: Oct. 12, 2007

(86) PCT No.: PCT/JP2007/070400

§ 371 (c)(1),
(2), (4) Date: Apr. 10, 2009

(87) PCT Pub. No.: WO2008/047891

PCT Pub. Date: Apr. 24, 2008

(65) Prior Publication Data

US 2010/0044558 A1 Feb. 25, 2010

(30) Foreign Application Priority Data

Oct. 13, 2006 (GB) ..... 0620398.8

(51) Int. Cl.
*H01J 49/40* (2006.01)

(52) U.S. Cl. ..... 250/287

(58) Field of Classification Search ..... 250/281–300
See application file for complete search history.

(56) References Cited

U.S. PATENT DOCUMENTS

| | | | | |
|---|---|---|---|---|
| 6,380,666 | B1 | 4/2002 | Kawato | |
| 7,385,187 | B2 * | 6/2008 | Verentchikov et al. | 250/287 |
| 7,772,547 | B2 * | 8/2010 | Verentchikov | 250/287 |
| 2006/0192110 | A1 | 8/2006 | Yamaguchi | |
| 2010/0193682 | A1 * | 8/2010 | Golikov et al. | 250/287 |
| 2011/0017907 | A1 * | 1/2011 | Makarov et al. | 250/282 |

FOREIGN PATENT DOCUMENTS

| | | | |
|---|---|---|---|
| GB | 2 080 021 | A | 1/1982 |
| JP | 2003-080537 | A | 3/2003 |
| JP | 2003-121418 | A | 4/2003 |
| SU | 1725289 | A1 | 4/1992 |

(Continued)

OTHER PUBLICATIONS

H. Wollnik et al., "An energy-isochronous multi-pass time-of-flight mass spectrometer consisting of two coaxial electrostatic mirrors", International Journal of Mass Spectrometry, 2003, pp. 217-222, vol. 227.

Michisato Toyoda et al., "Multi-turn time-of-flight mass spectrometers with electrostatic sectors", Journal of Mass Spectrometry, 2003, pp. 1125-1142, vol. 38.

Ji Qinchung et al., "A Segmented Ring, Cylindrical Ion Trap Source for Time-of-Flight Mass Spectrometry", Journal of the American Society for Mass Spectrometry, Oct. 1, 1996, pp. 1009-1017, vol. 7, No. 10.

(Continued)

*Primary Examiner* — Jack I Berman
(74) *Attorney, Agent, or Firm* — Sughrue Mion, PLLC

(57) ABSTRACT

A multi-reflecting TOF mass analyser has two parallel, gridless ion mirrors each having an elongated structure in a drift direction (Z). These ion mirrors provide a folded ion path formed by multiple reflections of ions in a flight direction (X), orthogonal to the drift direction (Z). The analyser also has a further gridless ion mirror for reflecting ions in the drift direction (Z). In operation ions are spatially separated according to mass-to-charge ratio due to their different flight times along the folded ion path and ions having substantially the same mass-to-charge ratio are subjected to energy focusing with respect to the flight and drift directions.

20 Claims, 10 Drawing Sheets

FOREIGN PATENT DOCUMENTS

| | | | |
|---|---|---|---|
| WO | 00/01878 | A1 | 1/2000 |
| WO | 2005/083742 | A2 | 9/2005 |
| WO | 2006/102430 | A2 | 9/2006 |

* cited by examiner

RELATED ART

RELATED ART

MULTI-REFLECTING TIME-OF-FLIGHT MASS ANALYSER AND A TIME-OF-FLIGHT MASS SPECTROMETER INCLUDING THE MASS ANALYSER

FIELD OF THE INVENTION

This invention relates to the field of mass spectrometry, particularly time-of-flight mass spectrometry. In particular, it relates to a TOF mass analyser having increased flight path due to multiple reflections.

BACKGROUND

The time-of-flight (TOF) method of mass spectrometry is based on a measurement of the time it takes for ions to fly from an ion source to a detector along the same path. The ion source simultaneously produces pulses of ions having different mass-to-charge ratios but of the same average energy. Thus, due to the laws of motion in an electrostatic field the flight time for ions having different mass-to-charge ratios (m/e) is inversely proportional to the square root of m/e. Ions arriving at the detector produce pulses of current which are measured by a control system and presented in the form of a spectrum. The mass-to-charge ratio of ions under investigation can be derived by comparing the position of their peak with respect to peaks of known ions (relative calibration) or by direct measurement of arrival time (absolute calibration). The narrower the peak of ions of similar mass the higher the accuracy of mass measurement provided that voltage supply and system dimensions are stable. For various types of mass-spectrometer relative peak width is characterised by a resolving power—the ratio of apparent mass to the peak width in mass units: $R_m=m/\Delta m$. In the case of TOF mass spectrometers the mass resolving power is equal to one half of a ratio of the total flight time with respect to the peak width in time units: $R_m=0.5\ t/\Delta t$. Thus, in order to achieve higher accuracy, it is necessary_either to reduce peak width as much as possible or to increase the flight time.

There are certain limitations to reducing peak width in TOF mass spectrometers. Even for ions having the same mass-to-charge ratio the ion source produces particles of similar, but slightly different energy. This is due to an initial spatial spread of ions in the ion source prior their to ejection. It is essential to optimise electrostatic fields in a TOF mass spectrometer in such way that ions having the same mass-to-charge ratio but different energies arrive at the detector at the same time. Thus, an ion optical path in TOF mass spectrometers is "energy isochronous" along the flight path direction. By appropriate optimisation, a high level of isochronicity can be achieved so that ions arrive at the detector at times that have very little dependence on their initial positions inside the ion source. Further reduction of the peak width is limited by the initial velocity spread of ions. The latter results in so-called "turn-around time" which is the difference of arrival times of ions having an initial velocity $v_T$ in a direction along the flight path and an initial velocity $-v_T$ in an opposite direction along the flight path. The difference is inversely proportional to a strength of electrical field at the moment of ion extraction from the ion source: $t_{turn}=2\ v_T/(eE/m)$. One way to reduce turn around time is to reduce the initial velocity $v_T$, for example by cooling ions inside the source, another way is to increase the field strength. Both approaches have certain practical limitations, which are almost exhausted in modem TOF mass spectrometry.

Another way to improve mass resolving power is to increase the flight time using a longer flight path. Although it is possible to increase the flight path simply by increasing the size of the instrument, this method is impractical because modern TOF systems already have a typical size of 1 m. An elegant way to increase the flight path is to use multiple reflections at electrostatic mirrors. Some known multiply-reflecting systems attempt to satisfy several conditions at the same time; that is, a multiply-folded beam trajectory along which the flight time of ions having the same mass-to-charge ratio, but different energies, is substantially independent of energy within an energy range produced by the ion source (longitudinal isochronicity), stable ion motion in the transverse direction so that the ion beam can survive multiple reflections, and a time-of-flight that is substantially independent of angular and spatial spread of the ion beam in the lateral direction (minimum lateral aberrations). These conditions have proved to be difficult to satisfy simultaneously, and know systems that do satisfy the conditions tend to be difficult to manufacture and/or lack flexibility.

PRIOR ART

A multiply folded trajectory with many reflections can be accomplished using a pulsed power supply (H. Wollnik, Int. J. of Mass Spectrom. And Ion Proc., 227, (2003), 217). In a system having two axially—symmetric coaxial mirrors (FIG. 1) ions are injected into the system by reducing voltage on the entrance mirror I for a short time. After ions have entered the system, voltage on mirror I is restored and ions are left to oscillate between the two mirrors for a sufficiently long time. Finally, ions are released from the system for detection at a detector by reducing voltage on the exit mirror II. Unfortunately, this method suffers from mass-range limitations because only a short mass range of ions can be ejected from a system in a single experiment. Ions of smaller mass travel faster and make more turns than heavier ions. After a certain number of turns, N, it is impossible to distinguish between heavier ions which made N turns and lighter ions which made N+1 turns. Thus, the mass range of ions ejected from the system in a single shot without overlapping of mass sub-ranges is inversely proportional to the number of turns. This deficiency applies to all systems in which ions follow the same trajectory for many passes and are released from the system by pulsed voltages (M. Toyoda et. all, Journal of Mass Spectrometry, 2003, v.38, pp. 1125-1142).

A number of electrostatic systems with multiple reflections were proposed by H. Wollnik in UK patent GB2080021. Systems described by H. Wollnik require complicated manufacturing and careful optimisation. A simpler system is described in Soviet Union Patent SU1725289 of Nazarenko et al (FIG. 2). Their system has two parallel, gridless ion mirrors to implement multiple reflections. Voltages on mirror electrodes 11,12,13 and 21,22,23 are optimised in such way, that the period of a complete single cycle with reflections at the upper mirror and the lower mirror is substantially independent of ion energy in the X (flight) direction. Due to this, ion packets are compressed (energy focused) at some point between the mirrors after each complete cycle. An ion beam is injected into the system at a small angle with respect to the X axis. As a result the ion beam travels comparatively slowly in the Z (drift) direction while being repeatedly reflected at the two parallel mirrors, thus creating a multiply-folded zig-zag-like trajectory with increased flight time. An advantage of this system is that the number of reflections that occur before ions reach a detector can be adjusted by changing the injection angle. At the same time, this system lacks of any means to prevent beam divergence in the drift direction. Due to initial angular spread, the beam width may exceed the width of the detector making further increase of ion flight time impractical due to loss of sensitivity.

A significant improvement of a multi-reflecting system based on two parallel planar ion mirrors was proposed by A. Verentchikov and M. Yavor in WO001878A2. Angular beam divergence in the Z direction was compensated by a set of lenses positioned in a field free region between the mirrors (FIG. 3). As in the system of Nazarenko, an ion beam is injected into a space between the mirrors at small angle with respect to the X axis, but the angle is chosen such that the ion beam passes through the set of lenses L1, L2, . . . , LD2. As a result, the ion beam becomes refocused after every reflection and does not diverge in drift direction. The last lens of the system LD2 is also operated as a deflector in order to reverse the direction of beam drift towards the exit from the system. In this mode of operation, the system provides a full mass range of operation with extended flight path. The deflector LD2 can also be used to confine the ion beam within an end section of the system in order to allow multiple reflections to take place there. In this mode of operation, the ion beam is released from the end section by application of a pulsed voltage to the deflector. In this case, the system suffers from mass range limitation in the same way as in the system of H. Wollnik. As experiment shows in this mode of operation a resolving power of 200,000 can be achieved with less than 50% loss in transmission. High resolving power results from of an optimum design of the planar mirrors which not only provides third order energy focusing, but also has minimum lateral aberrations up to the second order. The design proposed in WO001878A2 has many advantages over the original system of Nazarenko, but these advantages are achieved by sacrificing a very useful property of the original system; that is the possibility to increase the number of reflections by reducing the injection angle. In the system of Verentchikov and Yavor injection angle is fixed, being determined by the geometry of the system; that is, the distances between the mirrors and the positions and spacing of the lenses. The total number of reflections is set at twice the number of lenses and cannot be changed unless the pulsed mode of operation is used, but this results in reduced mass range. This is a disadvantage of the system which is addressed by embodiments of the current invention.

SUMMARY OF THE INVENTION

According to the invention there is provided a multi-reflecting TOF mass analyser comprising electrostatic field generating means configured to define two, parallel, gridless ion mirrors each having an elongated structure in a drift direction, said ion mirrors providing a folded ion path formed by multiple reflections of ions in a flight direction, orthogonal to the drift direction, and displacement of ions in the drift direction, and being further configured to define a further gridless ion mirror for reflecting ions in said drift direction, whereby, in operation, ions are spatially separated according to mass-to-charge ratio due to their different flight times along the folded ion path and ions having substantially the same mass-to-charge ratio are subjected to energy focusing with respect to said flight direction and said drift direction.

In an embodiment of the invention, the TOF mass analyser may be used as a delay line which may be incorporated in the flight path of virtually any existing TOF mass spectrometer with a view to improving overall mass resolution by virtue of the extended flight time created by the delay line. With the folded path configuration of the invention there is no limitation on the range of mass-to-charge ratio that can be accommodated by the analyser, and the need to manipulate the ion trajectory using pulsed voltage is avoided. Furthermore, ion motion in the transverse direction is relatively stable. This, in conjunction with the use of gridless ion mirrors helps to reduce ion loss from the analyser. The extended flight time gives improved resolving power of mass analysis and, in preferred embodiments, the number of reflections can be adjusted using electrostatically controllable deflector means to control an angle, relative to the flight direction, at which ions are directed onto the folded ion path. Such adjustment is not possible using known systems having lenses.

The invention introduces a completely novel feature in the design of TOF systems—that is, energy focussing in the drift direction, orthogonal to the flight direction. Prior to this, TOF systems were built in such a way as to minimise beam spread in the drift direction by accelerating beams to high energy in order to reduce overall angular spread or by using lenses to refocus the beam. In addition to the provision of ion mirrors in the flight direction the present invention proposes uses of an ion mirror in the drift direction (orthogonal to the flight direction) and may be used to produce an energy focus in the final position at the detector simultaneously with respect to both the flight and drift directions. Due to the isochronous property of the system beam width in drift direction during flight is irrelevant though, preferably the beam should not be wider than the detector when it is detected. This has the additional advantage of reducing the influence of space charge because most of the time ion packets travel elongated in drift direction.

BRIEF DESCRIPTION OF DRAWINGS

Embodiments of the invention are now described, by way of example only with reference to the accompanying drawings of which FIG. 1. is a schematic representation of a known axially symmetric multi-turn TOF mass spectrometer described by H. Wollnik, FIG. 2. is a schematic representation of a known planar multi-reflecting TOF mass spectrometer described by Nazarenko, FIG. 3. is a schematic representation of a known planar multi-reflecting TOF mass spectrometer described by Verentchikov and Yavor, FIG. 4. shows a 3D view of a multi-reflecting 2D Isochronous TOF mass spectrometer of a preferred embodiment of the present invention, FIG. 5. is a schematic representation of a multi-reflecting 2D Isochronous TOF mass spectrometer of a preferred embodiment of the invention, FIG. 6. shows a distribution of electric potential along the flight axis of the multi-reflecting system shown in FIG. 5, FIGS. 7*a* to 7*d* illustrate dependence of flight time on ion energy in a TOF system with an energy isochronous property, FIG. 8. shows a cross-sectional view of a 3D ion trap source.

DETAILED DESCRIPTION OF PREFERRED EMBODIMENTS

Figure 4:
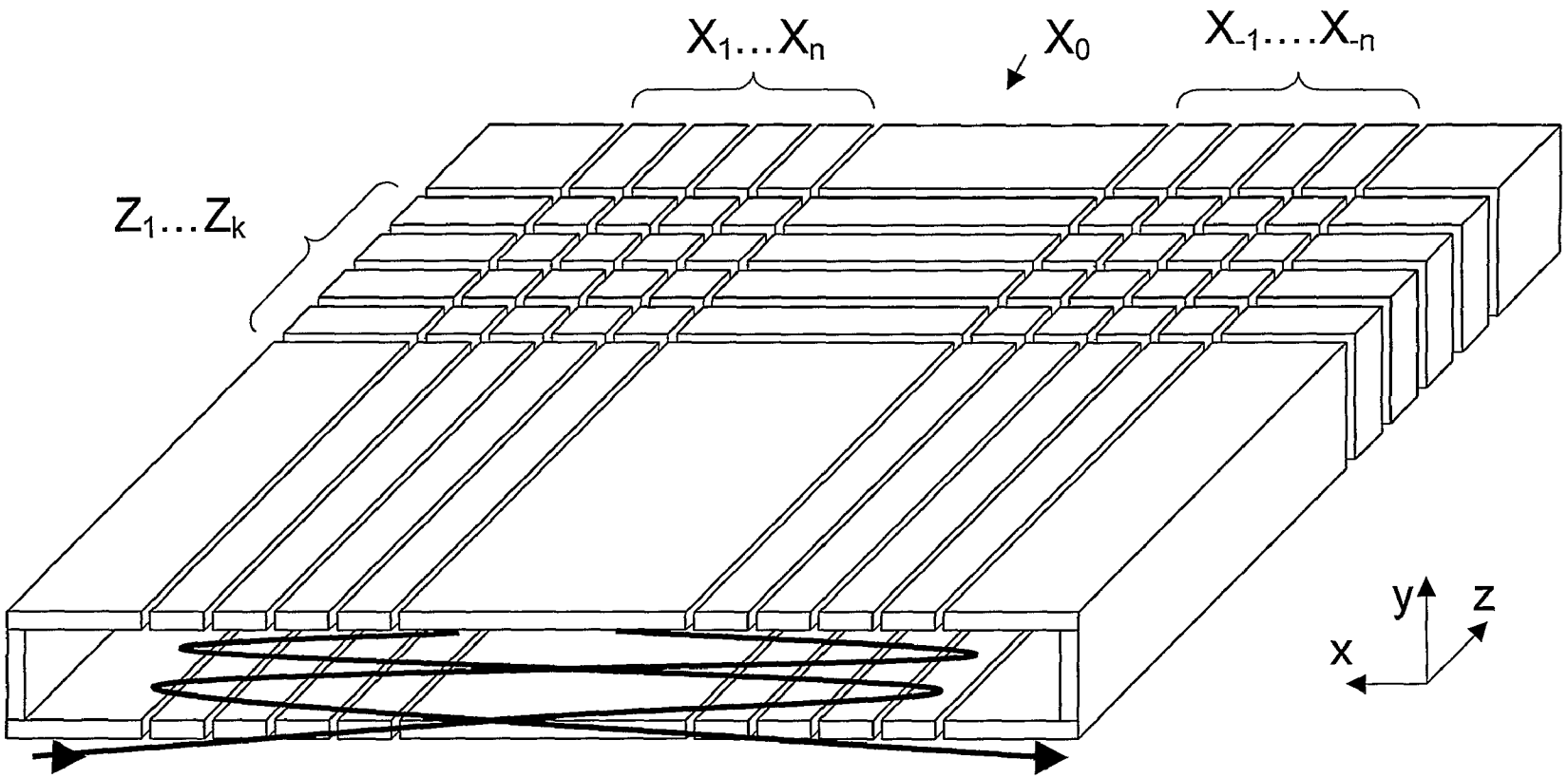
Figure 5:
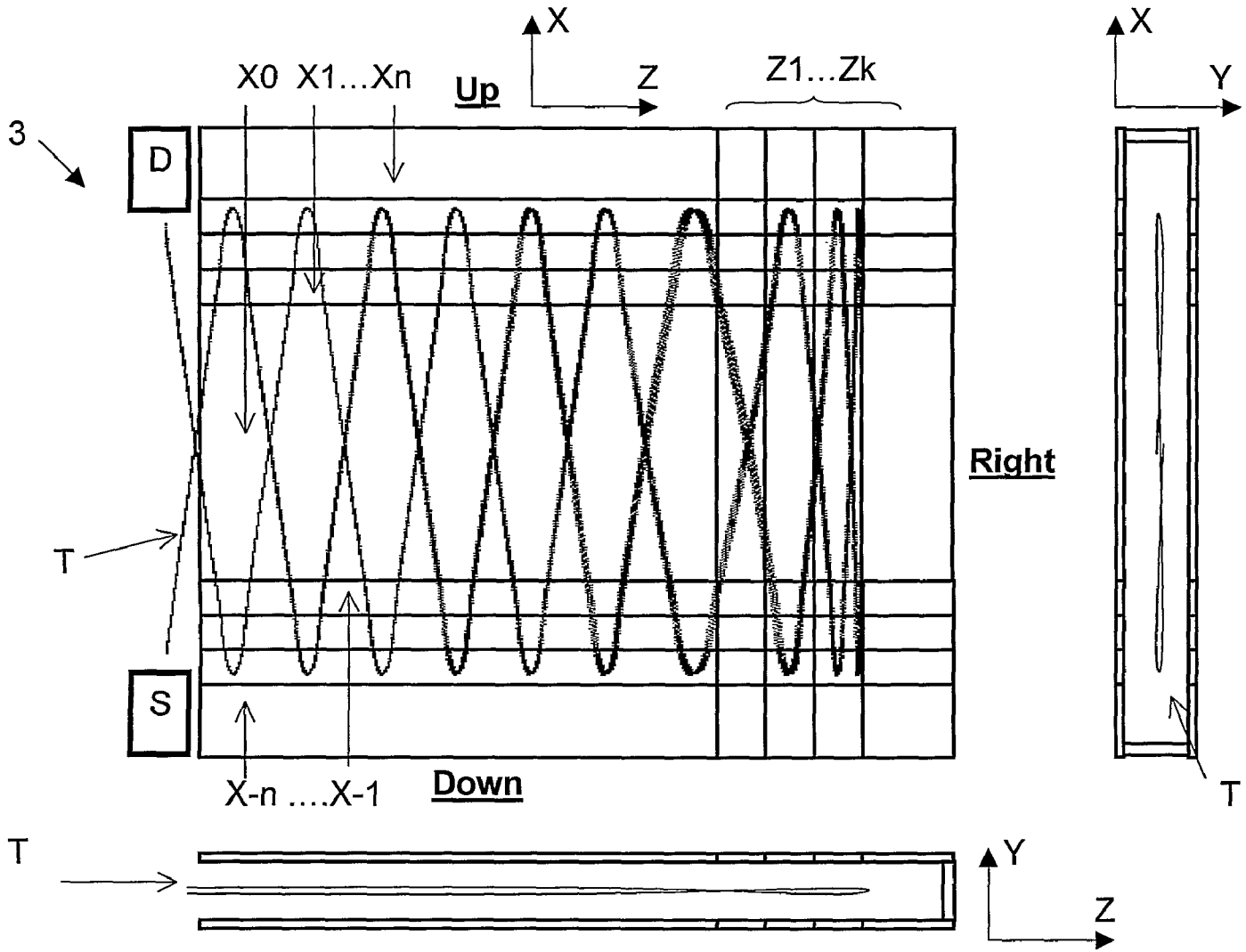

FIG. 4 shows a 3D view of the novel multi-reflecting 2D isochronous TOF mass analyser according to a preferred embodiment of the invention. The 2DTOF analyser consists of a set of metal plate electrodes positioned in two parallel planes orthogonal to the Y axis. Electrodes in the upper and lower planes are symmetrical and have the same applied voltages. The plate electrodes are arranged in lines $X_1, X_2, \ldots, X_n$ and $X_{-1}, X_{-2}, \ldots, X_{-n}$ parallel to the Z axis. These electrodes form two gridless electrostatic ion mirrors for reflecting ions in the flight direction X. Each X line electrode is subdivided into a number of segments so as to create lines $Z_1, Z_2, \ldots, Z_k$ of electrodes which extend parallel to X axis. These lines of electrodes are used to form an ion mirror in the drift direction Z. FIG. 5 shows a schematic representation of the 2DTOF system in 3 orthogonal views with a typical ion trajectory (T) through the system. 2DTOF analyser 3 comprises an ion source S and an ion receiver D. Two sets of plates X0, X1, X2, . . . , Xn and X-1, X-2, X-n in parallel planes form ion mirrors (Up and Down) for multiple reflections in the X direction and a set of plates in columns Z1, Z2, . . . , Zk which create an ion mirror (Right) for reflection in the drift direction Z. Such an arrangement of ion mirrors makes it possible for ions to have a multiply folded trajectory with many reflections between Up and Down mirrors and a single reflection at the Right mirror. The trajectory of ions starts in an ion source and ends in an ion receiver.

Incorporation of an ion mirror for reflection in a drift direction is a completely novel feature in multi-reflecting TOF MS which makes it possible to avoid beam spreading in the drift direction without the need for lenses and deflectors. This design of 2DTOF analyser allows the number of reflections to be electronically adjustable which is not possible in configurations of the prior art having fixed lenses. Requirements for achieving these properties are as follows:

1) On arrival at the surface of the detector ion packets of similar mass but different energy are compressed (focused) in the flight direction (X focusing)
2) on arrival at the surface of the detector ion packets of similar mass but different energy are compressed (focused) in the Drift direction (Z focusing).
3) Ion motion in Y direction is confined within a sufficiently small range near the ZX plane
4) The TOF is substantially independent of the beam angular and positional spread in the direction orthogonal to the ZX plane.

Means to achieve these properties are considered in more detail below.

In general, an ion optical scheme of a 2DTOF mass analyser is designed in such a way that field inside the mirror is a composition of two fields:

$$\Phi(x,y,z)=\phi_1(x,y)+\phi_2(z,y). \tag{1}$$

Both functions $\phi_1(x,y)$, and $\phi_2(z,y)$ satisfy Laplace's equation for electrostatic field potential. Ion motion in the x and z directions is described by the following equations $$m\frac{d^2x}{dt^2} = -e\frac{\partial}{\partial x}\varphi_1(x, y), \tag{2}$$

$$m\frac{d^2z}{dt^2} = -e\frac{\partial}{\partial z}\varphi_2(x, y). \tag{3}$$

Displacement in the y direction is usually substantially smaller that the characteristic size of a system which allows y to be set at zero in the above equations. In this case, motion in the flight direction X and in the drift direction Z are independent of each other and can be considered separately.

Figure 6:
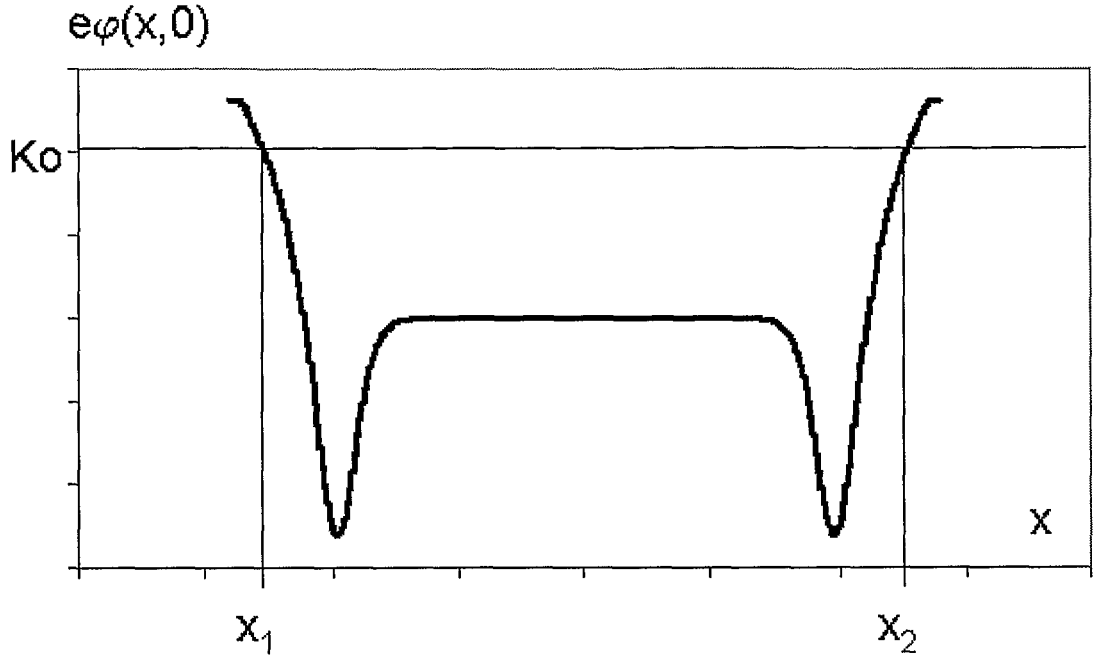

Considering the X motion first, potential distribution in the X direction is described by a function $\phi_1(x,0)$, which has the form of a potential well which may have a complicated shape, as shown in FIG. 6. Kinetic energy Ko in the X direction is lies below the top of the potential well as shown in FIG. 6 forcing ions to undergo many reflections between turning points $x_1$ and $x_2$. From equation (2) the period of one complete oscillation between turning points $x_1$ and $x_2$ is derived as follows:

$$T(K_0) = 2\int_{x1}^{x2} \frac{dx}{\sqrt{2[K_0 - e\varphi_1(x, 0)]/m}} \tag{4}$$

Figure 7:
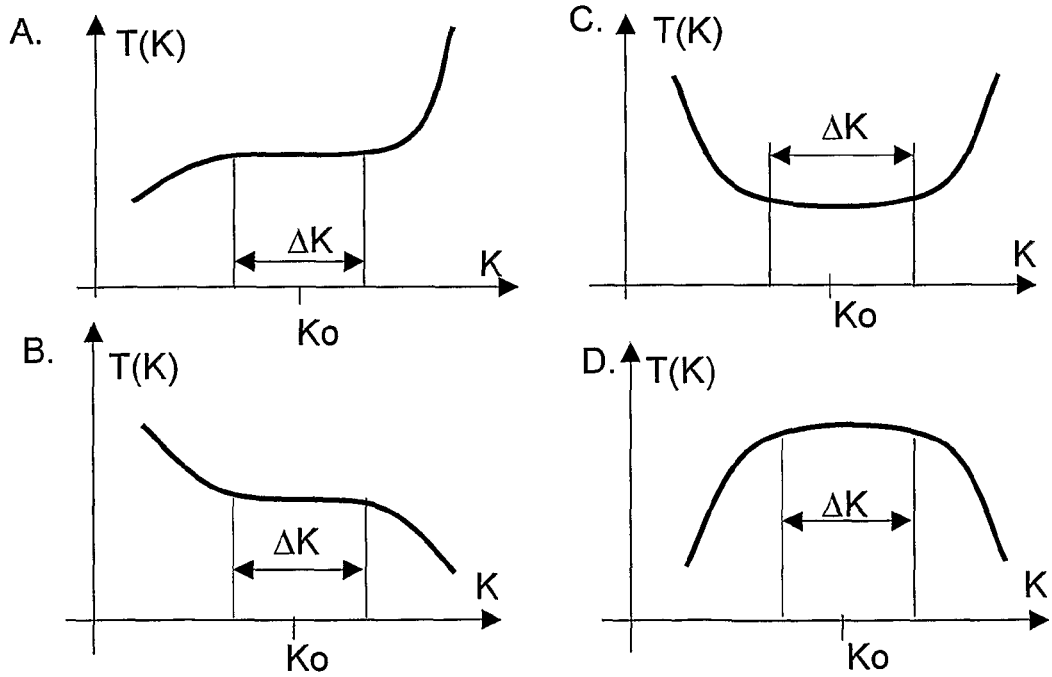

For many TOF applications the shape of the potential function $\phi_1(x,0)$ is selected in such way that the period of ion oscillation (4) is independent of ion energy within some range of energies ΔK near Ko as shown in FIG. 7. There is an infinite number of possibilities (functions $\phi_1(x,0)$) which satisfy this condition with different levels of accuracy. Due to Laplace's equation, potential distribution along the axis $\phi_1(x,0)$ also defines field in the vicinity of the axis: $\phi_1(x, y)$. For multiple reflections between mirrors, the field distribution should also satisfy requirements of y-motion stability and independence of time of flight from an initial displacement of ions in y direction (lateral aberrations). Such distributions can be found by means of optimisation of ion's time-of flight dependence against kinetic energy and lateral position on a selected class of potential functions. In practice, the field distributions are realised by sets of electrodes $X_1, X_2, \ldots X_n$, and $X_{-1}, X_{-2}, \ldots X_{-n}$. The total number of electrodes, their size and applied voltages Vx1, Vx2, . . . , Vxn are selected in such way as to reproduce a desired potential distribution along the X axis as close as possible. An optimised TOF system has an isochronous property in the flight direction, which means that ions having the same mass-to-charge ratio but different energies in the flight direction starting simultaneously from a mid-plane between the two ion mirrors will arrive at the same plane simultaneously after having undergone one (or several) reflections at the mirrors. It also implies that if ions cross the mid-plane at different times they will have the same time difference after several reflections between the ion mirrors. Thus, if ions having different energies enter the system at different times they will exit the system with the same time difference. In other words the 2DTOF system maintains a time delay between ions having the same mass-to-charge ratio but different energies in the flight direction after several reflections in the flight direction.

To create a 2DTOF system of the invention it is necessary to establish another field in the Z direction which will provide an isochronous property in the drift direction. Potential distribution $\phi_2(z, y)$ is found from optimising a 2D system in the same way as described above for the X mirrors. In particular, the same field distribution $\phi_1(x, y)$ can be used for field in the Z direction but with smaller voltages in order to account for a smaller flight energy in the drift direction. In this case the voltage distribution in the Z direction can be expressed simply as:

$$\varphi_2(z, y) = \frac{Kz}{Ko}\varphi_1(z, y). \tag{5}$$

The field distribution of eq. 5 will provide an isochronous motion in the Z direction for energy Kz within the same relative energy spread ΔKz/Kz as a mirror in X direction. As will be described later, an ion beam has similar relative energy spreads in the flight and drift directions. Thus the field of eq. 5 will provide an ion mirror with sufficient energy range. A disadvantage of this design is that the length of Z mirror will be half the length in X direction, which may be insufficient if a longer flight path is required. When longer flight distance in drift direction is required a mirror with a longer focusing distance in the Z direction could be used.

A 2D mirror in the Z direction can be formed from by a set of plate electrodes aligned parallel to flight X axis and orthogonal to the drift axis Z. The total number of electrodes k, their size, positions and applied voltages Vz1, Vz2, . . . , Vzk are determined from the properties of the field distribution along the Z axis. In order to create such plates in addition to the plates for X mirrors, each electrode of the X mirrors is subdivided into K+2 segments, each segment having the same width in each Z column. As a result, upper and lower electrode plates of the 2DTOF system are created from parallel sets of planar segments arranged in 2N+3 lines and K+2 columns as shown in FIG. 5. Electrodes in X lines carry voltages required for creating ion mirrors in the X direction: Vx1, Vx2, . . . , Vxn. Superimposed on these voltages additional voltages are applied for creating fields in the Z direction Vz1, Vz2, . . . , Vzk. For example, to create a field $\phi_2(z,y)$ in the ZY plane the same voltage Vz1 is added to all plates in column Z1, the same voltage Vz2 is added to all plates in column Z2 and so on. Or, in other words, voltage applied to a plate electrode in line i and column j should be Vxi+Vzj. Due to the superposition principle such an arrangement of electrodes and supply voltages will create a field distribution of eq. 1 in the space between them.

For an infinite length of boundary plates in the X and Z directions it is possible to create a system for which equation (1) is valid exactly. In practice however, the electrodes are of finite length which means that field near corners and back planes of a system will be distorted making equation (1) inapplicable. Although it is possible to optimise a system when (1) is not applicable, it is preferable to deal with a situation when motion in the X and Z directions are separated. It is known that in a system of two parallel plates field distortions decay exponentially as exp(−3.42·x/R), where x is a distance from a distortion and R is a gap between the plates. At a distance R, distortion will decay at 3% and at 2R it will be smaller than 0.1% of original value. Hence, it is always possible to create a system where the influence of fringing fields is negligible by making the back plates of the ion mirrors sufficiently wide. It is preferable to make sure that ion trajectory (T) does not approach the back planes closer that the gap between the parallel plate electrodes forming the ion mirrors, as shown in FIG. 5. It is possible to ensure this by making the width of back planes in each mirror bigger than the gap between planes or by making the back electrode from several electrodes.

Although it is possible to create a superposition of two independent fields in the flight and drift directions, lateral motion is influenced by both fields. Motion in the Y direction is described by the equation $$m\frac{d^2y}{dt^2} = -e\frac{\partial}{\partial y}\varphi_1(x, y) - e\frac{\partial}{\partial y}\varphi_2(x, y), \tag{6}$$

It appears that motion in the Y direction depends on both fields. At the same time, the influence of these fields is different. The reason for that is a big difference of ion energies in the X and Z directions. Typically, ion drift energy is 100 times smaller than the flight energy and, correspondingly, the maximum voltage applied to the Z mirror plates may be 100 times smaller than the voltage applied to the X plates. It follows that the field created by the Z direction ion mirror will be at least two orders of magnitude smaller than fields created by the X axis ion mirrors. That is why the second term in equation (6) is at least two orders of magnitude smaller than the first. Another reason for the small influence of the Z field is that most of the ion reflections occur in a field free region of the Z mirror, where field $\phi_2(z,y)$ equals zero. Influence of Z fields on motion in the Y direction is only effective when ions enter the Z mirror, and can be further reduced by making field $\phi_2(z,y)$ almost independent of y. This is the case for a field which has a linear dependence in the Z direction. A gridless mirror having a linear field still has dependence in Y direction at the beginning of linear field, but this dependence is localized and much smaller in magnitude than in the other mirrors. A mirror with a linear field does not provide high order focusing, but for motion in the drift direction this is not required, because of the fewer number of turns. For these reasons influence of Z fields on Y motion in the system is negligible or minor as compared to that of the X fields and optimisation of ion motion in Y direction can be carried out for X motion only, at least to a first approximation.

The foregoing describes a method for creating the required field distributions using parallel plate electrodes. Other methods to produce required electrostatic fields can be used. A traditional approach is to replace equipotential surfaces of the field with metal electrodes and to apply corresponding voltages to these electrodes. In this approach potential distribution is established by the shape of electrodes and cannot be modified electronically. Another method of obtaining the required fields in a space between two plates is to create a resistive coating with variable depth over the plate surfaces; the depth of resistive coating is calculated from the desired potential distribution on the surface. When supply voltage is applied a non-uniform voltage distribution is established over the surface of plate electrode due to the resistive coating resulting in a desired field distribution between plates. This method does not offer the possibility to electronically adjust the field and is not preferred.

Figure 8:
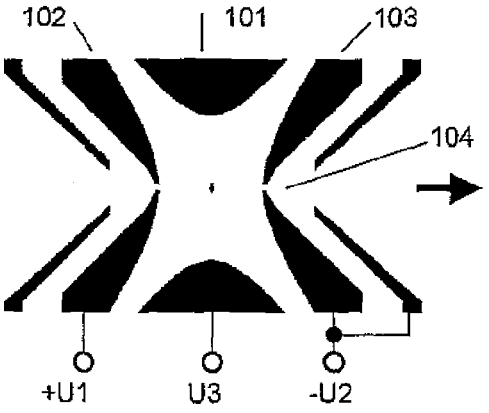
Fig.8 RELATED ART
Figure 9:
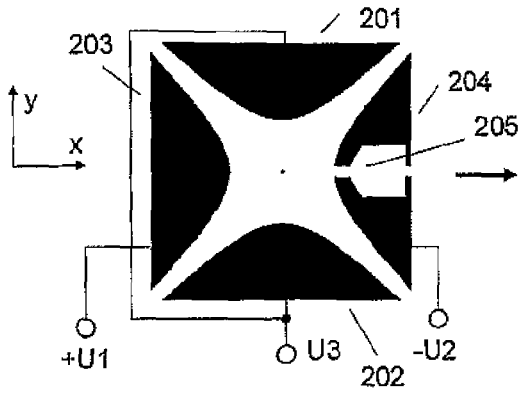
Fig.9 RELATED ART
FIG. 9. shows a transverse cross-section at view of a linear ion trap source with orthogonal extraction, FIG. 10. shows a cross-sectional view of a linear ion trap source with axial extraction and an additional acceleration stage. Potential distribution along the axis of the two-stage source is also shown.

Requirements of energy focusing in the X direction are very severe because ions undergo many reflections. It is preferable to use ion mirrors in the X direction with high order focusing and minimum aberrations in as wide an energy range as possible and over as large a longitudinal distance (Z direction) and as large an angular spread (Y direction) as possible. The only ion mirror which has ideal focusing properties for a full energy range is a mirror having a parabolic potential distribution: $\phi_1(x, y)=-c(x^2-y^2)$. Unfortunately for such a mirror lateral motion (in Y direction) is unstable. Mirrors with other types of potential distribution can provide stable motion in the Y direction, but they have an energy focusing property for a limited energy range only. The smaller the energy spread of the beam the better the energy focusing that is achieved. Methods of obtaining ion beams with a narrow energy spread are known in the art. Such beams are created by pulsing ions from a region between two plates (pulsar) or from an ion trap. In the case of injection from a pulsar a new pulse of ions cannot be injected until the ions of the previous pulse have arrived at the detector. Because of this, only a small portion of the beam can be analysed thus reducing the duty cycle. For a 2DTOF according to this invention, injection from an ion trap is preferred. FIG. 8 shows a cross sectional view of a 3D ion trap source as described in U.S. Pat. No. 6,380,666B1, consisting of a ring electrode 101 and a pair of end caps 102 and 103. Prior to extraction, ions are confined inside the trap by oscillating RF potentials. Due to collisions with neutral particles (helium gas is typically used) ions are collected in a small cloud near the centre of the trap. At some time, a high potential difference is applied to the end caps and ions are extracted into TOF through a hole 104 in the exit end cap 103. Different kinds of ion trap can be used as a source for a TOF. FIG. 9 shows a cross sectional view of a linear ion trap source with orthogonal extraction as described in WO2005083742. Operation of this ion trap source is similar to that of a 3D ion trap. The trap includes four elongated rods 201, 202, 203, 204. Prior to extraction, ions are confined radially within the trap by oscillating RF potentials on the rods and along the trap axis by a repulsive DC potential applied to adjacent electrodes (not shown). Ions are collected near the trap centre in a cloud which is elongated along the trap axis. During extraction, a high potential difference is applied between the rods 203 and 204 and optionally to the rods 201, 202. Ions are ejected from the trap through a narrow slot 205 in one of the rods.

Before extraction ions have almost the same energy as the buffer gas which is significantly smaller than the flight energy. Due to properties of ion motion in electrostatic field the ion energy equals the difference of potentials between the start point and the final point. Hence after extraction, the energy difference between ions equals the difference of the extracting potentials across the ion cloud. Average flight energy, on the other hand, equals the difference in potentials between the cloud centre and the ejecting electrode. Assuming that the extraction field is nearly uniform the energy spread of the beam can be estimated as the ratio of cloud width to the distance of the cloud centre from the extracting electrode. With an ion cloud of 0.5 mm in diameter and extraction distance of 5 mm this ratio is 0.1 and the corresponding energy spread is smaller than 10%.

Figure 10:
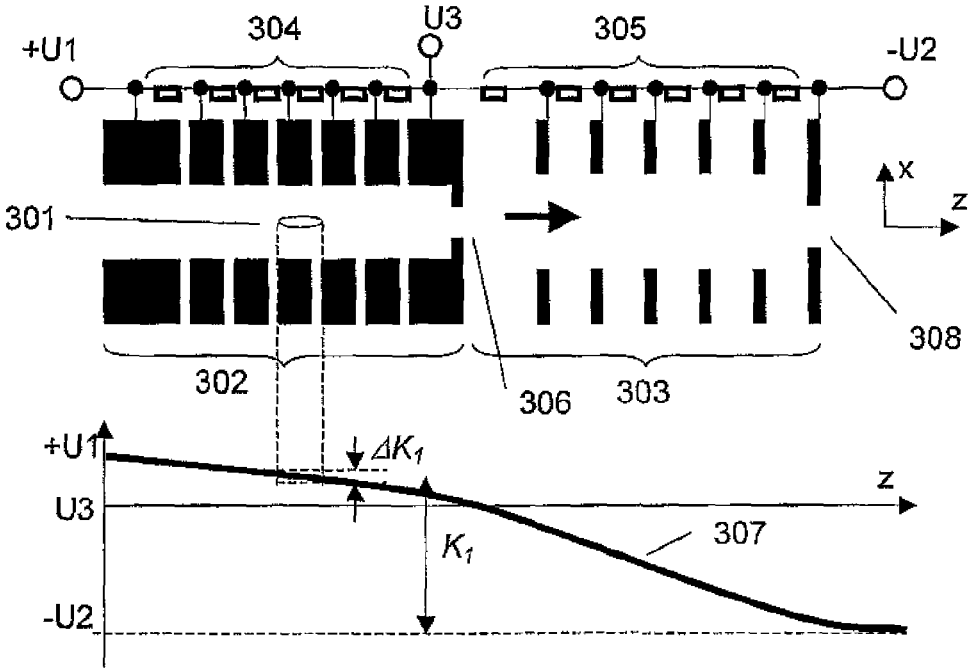

Further reduction of energy spread can be achieved by using a two-stage acceleration source of FIG. 10. It is based on a linear ion trap with segmented rods 302. Downstream of the ion trap there is a set of diaphragm electrodes 303 which create a field providing a second acceleration. Ions are trapped and collected in a cloud 301, which is elongated along the Z axis of the ion trap. For extraction, a potential difference is applied to all segments of the trap through a potential divider 304. An additional acceleration voltage U2 is applied to the electrodes of the second acceleration stage through a potential divider 305. Potential distribution 307 along the Z axis of the system is established for extraction. Ions leave the ion trap through a hole in extracting electrode 306 with average energy equal to the potential difference between the hole and the original position of the cloud centre. Energy spread of the cloud is determined by the relative cloud size with respect to the distance to the hole and can be less than 10%. After passing through second acceleration distance 303 all ions increase their kinetic energy by an amount equal to the potential difference between the extracting electrode and the last electrode of accelerating stage 308. Because the energy difference between ions is not changed, while the total energy is increased, the relative energy spread of the beam is reduced. For example by accelerating a 100 eV beam to 1 kV, an original energy spread of 10% is reduced to 1%.

Means other than segmenting the rods can be used in order to create an extraction field inside the linear ion trap. For example, a surface of the ion trap can be resistively coated, or additional inclined electrodes can be placed between the main trapping electrodes of the trap in order to create a linear potential distribution along the Z axis of trap. In similar fashion, a field for a second stage of acceleration can be created not by a set of diaphragms 303, but by a tube having a resistive coating. Both first and second acceleration fields may be non-uniform in order to focus the beam in the radial direction. This may be achieved by appropriate selection of the resistor chain in potential dividers 304 and 305 or by an appropriate depth of resistive coating.

The section above describes different methods for ejecting ions from ion trap sources while maintaining a desirable small energy spread.

Figure 11:
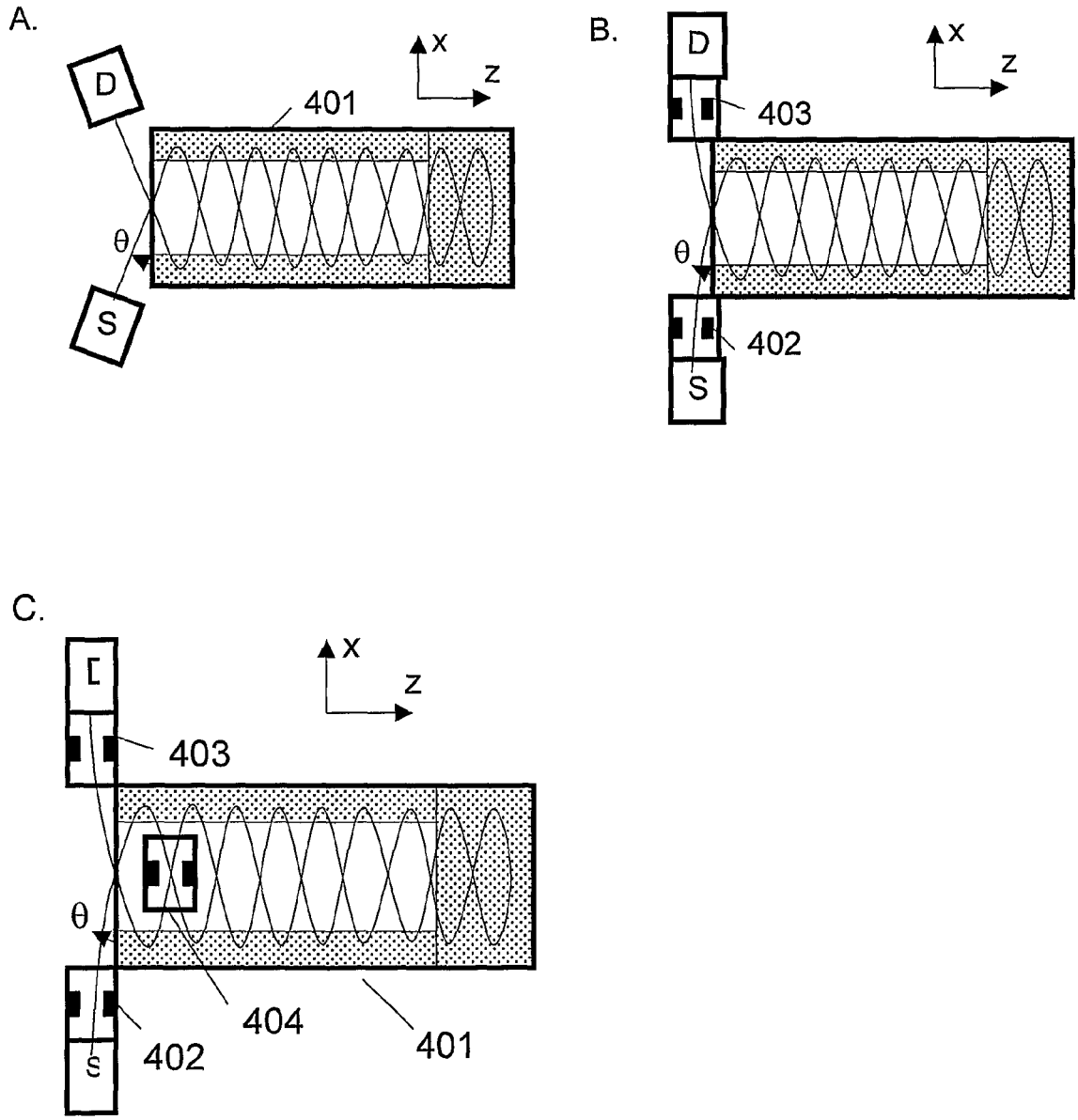
FIGS. 11*a* to 11C show different arrangements for introducing ions into the flight path of a 2D isochronous TOF system of the invention, FIG. 12. is a schematic representation of a 2DTOF analyser having two ion mirrors in the drift direction and a multiply folded looped beam trajectory using a pulsed deflector, FIG. 13. is a schematic representation of a 2DTOF analyser having two ion mirrors in the drift direction and a multiply folded beam without using pulses, FIG. 14. is a schematic representation of a 2DTOF analyser used as A) a delay line in a conventional TOF mass spectrometer and B) a mass selector for precursor ions.

Different methods can be used for injecting ions into the proposed 2DTOF system. In the simplest case the ion beam is injected directly from a source (S) into the system at small angle θ with respect to the X axis (FIG. 11.A). Inside 2DTOF 401 the ion beam undergoes multiple reflections in the X direction and a single reflection in the Z direction and finally arrives at detector D. In this method of injection energy in the flight direction (the X axis direction) as well as injection energy in the drift direction (the Z axis direction) are determined by the injection angle as follows: $K_x=K_0 \cos^2(\theta)$, $K_z=K_0 \sin^2(\theta)$, where Ko is a total energy of the beam. After entering the system, the ion beam undergoes a single reflection in the drift direction and an even number of reflections in the X direction. In order to realize such a trajectory, periods of reflections in the X and Z directions should satisfy the condition: $T_z(K_z)/T_x(K_x)=2n$, n=1, 2, . . . , which is always possible to achieve by an appropriate selection of voltages applied to the Z and X ion mirrors. It is important to mention that the relative energy spread in each direction X and Z is the same as in the injected beam. Consequently if the energy spread in flight direction (X) is 1% it will also be 1% in the drift direction (Z), even if drift energy is much smaller than flight energy, 1 eV say. The relative energy spread for which ion mirrors in X direction and Z direction should provide sufficient energy focusing is the same, whilst their absolute energies are different. Depending on the value of the injection angle energies in the X and Z directions can differ by two orders of magnitude (for example with an injection angle tg(θ)=0.1). In modem TOF mass spectrometry ion mirrors are optimized for a relatively high flight energy of few keV and relative energy spread of few percent. Due to properties of ion motion in an electrostatic field, the same mirrors will provide energy focusing of the same order and with the same relative energy spread at a lower flight energy if all supply voltages are reduced in proportion. This shows that the ion mirror in drift direction Z can be designed properly for a beam of small energy.

Figure 1:
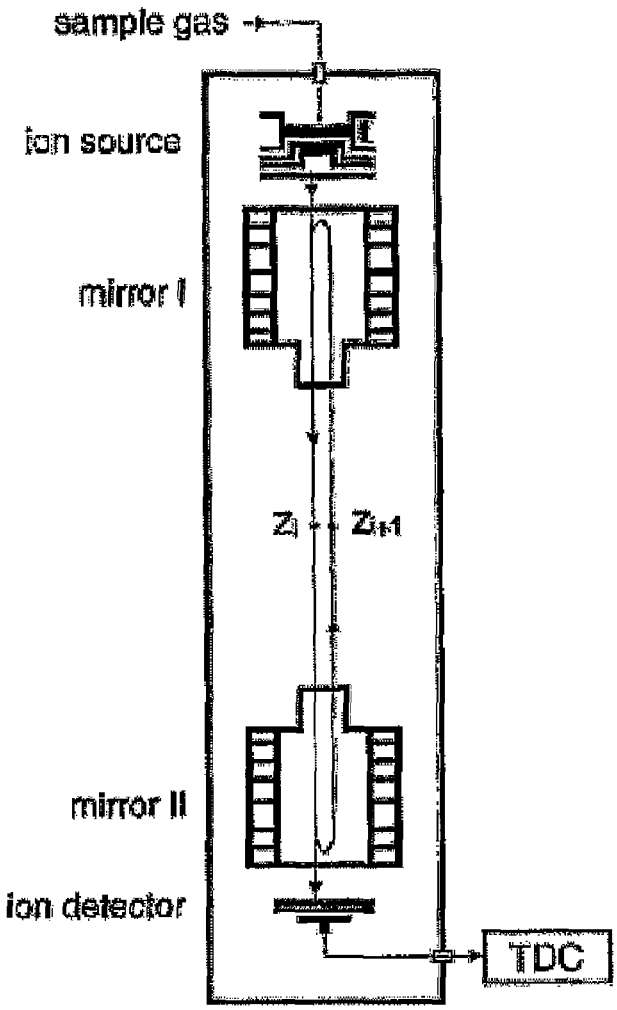
Figure 2:
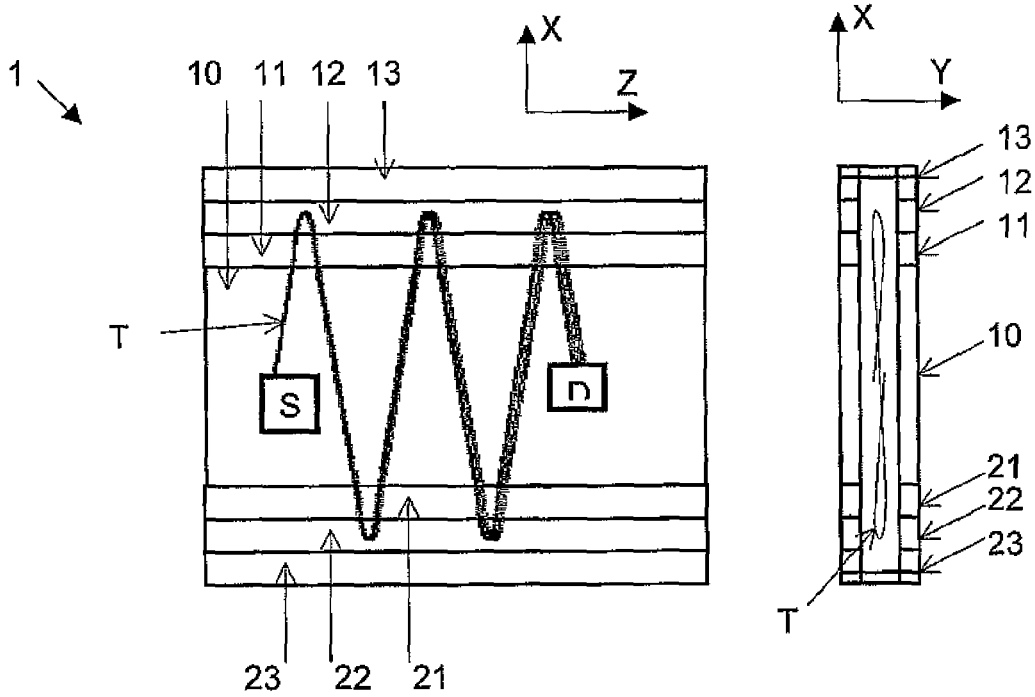
Figure 3:
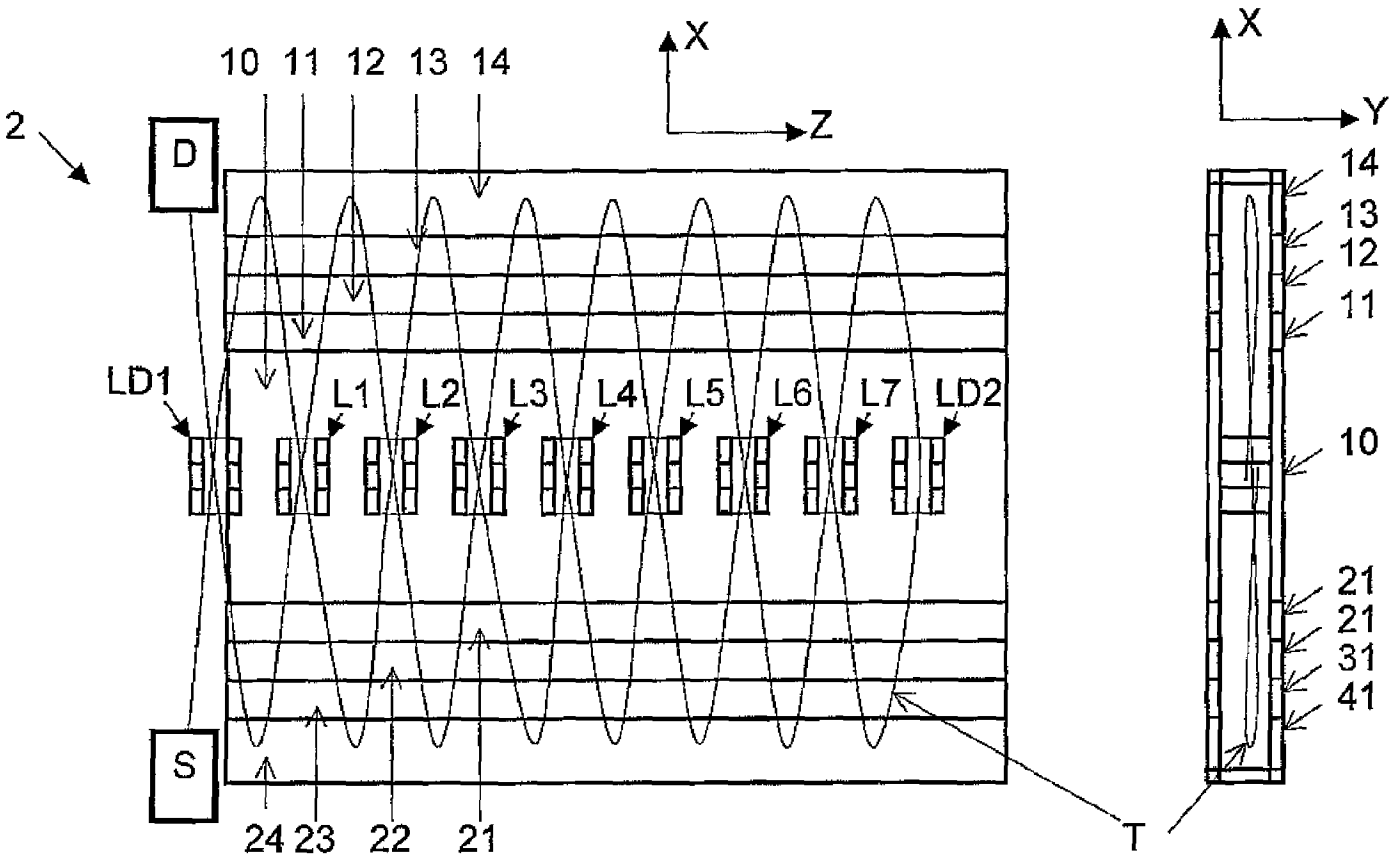
Fig. 3 RELATED ART

Another method of injection into the 2DTOF system is shown in FIG. 11.B. In this case two deflectors 402 and 403 are used. The ion beam is ejected from the source (S) and moves parallel to X axis with flight energy $K_x$. After passing through deflector 402 ions acquire additional energy $K_z$ in the Z direction and the beam is deflected through a small angle: $tg(\theta)=\sqrt{K_z/K_x}$. The amount of energy received by an ion in the Z direction depends on it's flight time through the deflector and hence on it's energy in the X direction. If the original beam has a small energy spread in the X direction then after passing the deflector the beam will have a similar relative energy spread in the drift direction Z. As in the previous case, relative energy spreads in both directions are the same. Mirrors X and Z are optimized for energy focusing at energies $K_x$ and $K_z$ correspondingly within a similar relative energy spread. The injection method of FIG. 11.B has an advantage that injection angle θ can be modified electronically. Using smaller injection angles it is possible to increase the number of reflections thus increasing the flight time and resolving power of mass analysis. This feature gives the system a considerable advantage compared with the prior art. In the system of Verenchikov and Yavor (FIG. 2) the injection angle is fixed, being defined by the position of lenses. It cannot be modified. The only way to increase the number of reflections is to use pulsed deflection in lenses LD1 and LD2 which results in the looping of the ion trajectory and gives rise to mass range limitations. The system of FIG. 11B is free from this drawback, although use of different injection angles requires a corresponding readjustment of voltages applied to ion mirrors X and Z. Readjustment of the mirrors for a different energy requires only proportional change of the supply voltages. For example, if energy in X direction has increased by 10% and energy in Z direction has reduced by 50% then all supply voltages Vx1, Vx2, . . . , Vxn should be increased by 10%, and supply voltages Vz1, Vz2, . . . , Vzk reduced by 50% and superimposed on the Vxn voltages in each column. Thus injection at different angles is possible in the proposed 2DTOF.

As shown in FIG. 11C, directing the beam into a looped trajectory is also possible using an additional deflector 404 placed in the field free region. When the beam is injected into the system this deflector is switched off and does not affect the beam. After a first reflection at the Z mirror, the beam returns to the exit and passes deflector 404 for the second time. At this time the deflector is switched on and directs the beam back towards the Z mirror. In this way the beam will be reflected between deflector 404 and the Z mirror for as long as deflector is switched on. After a sufficient number of reflections, the deflector is switched off and the beam is passed to the detector D, or into downstream processing stages. A similar type of operation is possible in a closed 2DTOF system 501 shown in FIG. 12 having two mirrors in the Z direction. In this case, an additional deflector 504 is placed in a field free region of the mirrors and can deflect the beam in both the Y and Z directions simultaneously. An ion beam from the source S is directed onto the flight path by two deflectors 502 and 504. Just after injection, deflector 504 is switched off and the beam is reflected between the X and Z mirrors for a sufficient number of reflections. Finally, deflector 504 is switched on and the beam is directed towards detector D through a deflector 503.

Figure 13:
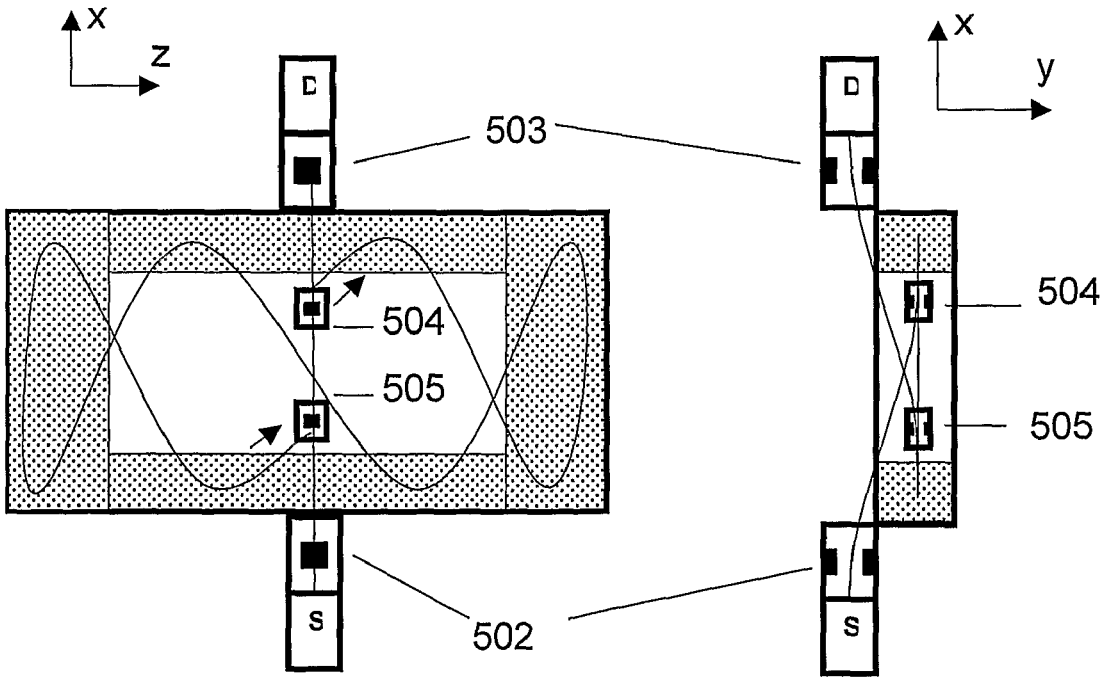

In a system providing multiple turns on a looped trajectory, the mass range which can be ejected in a single shot is limited and decreases inversely in proportion to a number of reflections in the Z direction. In a preferred embodiment, the number of turns in the Z direction can be made small, because even a single reflection in the Z direction provides a substantially longer flight path. If the flight path of a single turn is not sufficient a closed system with two Z mirrors can be used to provide a longer flight path as shown in FIG. 13. In this case, the ion beam is directed into the system using two deflectors 502 and 504 which are left on. Deflector 504 is a two-way deflector which aligns a beam in a plane of the 2DTOF analyzer by deflecting the beam in the Y direction and also provides drift velocity by deflecting the beam in the Z direction. The beam trajectory inside the 2D TOF system is arranged in such way that after a first reflection in the Z direction, the ion beam passes between deflectors 504 and 505 and undergoes another reflection in the Z direction before leaving the system through a pair of deflectors 505 and 503. The number of reflections in the X direction can be adjusted by appropriate selection of injection angle as long as the beam does not intersect deflectors 504 and 505. The number of reflections in the drift direction Z can be made bigger provided that the deflectors are sufficiently small and the beam trajectory does not intersect the deflectors.

It will be appreciated that it is possible to use electrostatic sector fields to introduce ions onto, or direct ions from the flight path within the 2DTOF analyser as an alternative to using deflectors.

Considerations above show that it is possible to build a system in practice and describe methods of its operation. Consideration is now given to how a system of this kind can be used to construct an improved TOF system or give improved performance of existing TOF systems.

Figure 12:
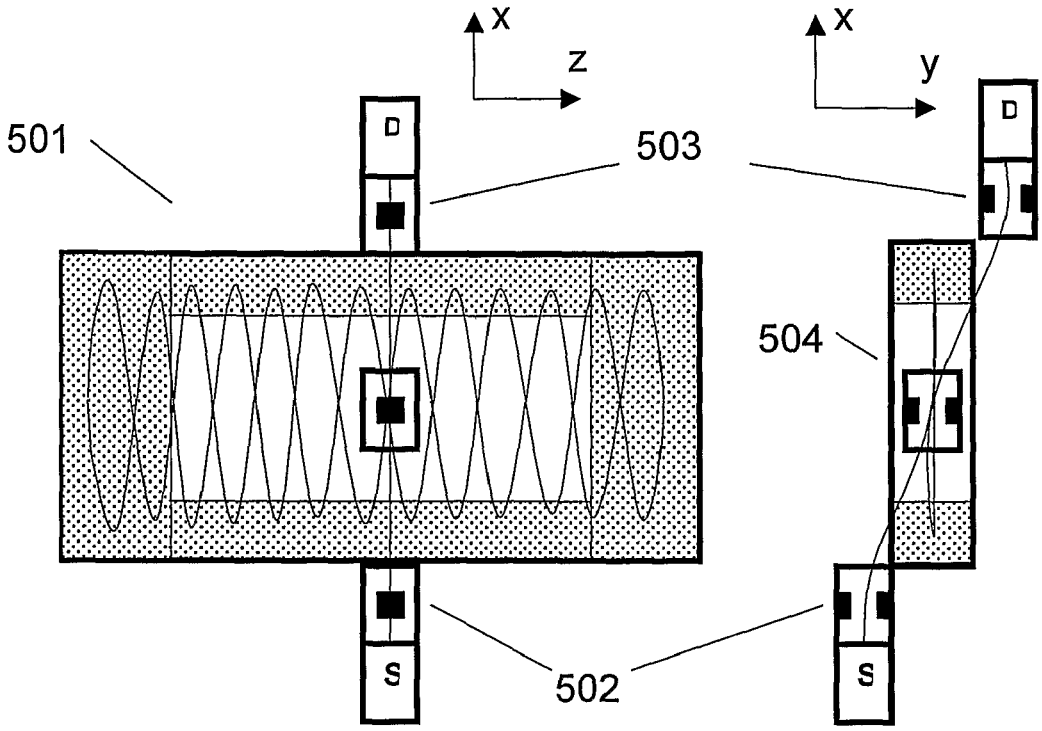

As described in FIGS. 11, 12 and 13, embodiments of a 2DTOF system according to the invention can be used as a standalone mass spectrometer of high mass resolving power. In order to obtain high resolving power ion packets of similar mass should be compressed (energy focused) at the surface of detector (D), that is, ion packets should be compressed in a direction orthogonal to the surface of detector, the flight direction X. This may be accomplished using different methods. When a simple ion source having a single acceleration stage (FIGS. 8, 9) is used ions having the same mass-to-charge ratio, but a spread of energies, will come to a focus at an isochronous point at a distance which is spaced from the ion source by approximately twice the length of the acceleration stage. Then, after passing through this isochronous point ions of higher energy will move ahead of less energetic ions. Typically, the acceleration stage is short (e.g. 1 to 10 mm) and so, in practice, the isochronous point might lie outside, and upstream of, the 2DTOF system. In this case, ions will undergo field-free flight for a substantial distance before entering the 2DTOF system causing the ions to separate according to their different velocities. This separation has a non-linear dependence on ion energy because of the non-linear relationship between ion energy and ion velocity.

The energy-independent period T(K) described with reference to equation 4 and FIG. 7 is based on an optimised isochronous system which, as described earlier, will maintain a time difference between ions having the same mass-to-charge ratio, but different energies, that enter the system at different times. Thus, the optimised isochronous system described earlier cannot be used to correct for the above-mentioned separation of ions due to their field-free flight outside the 2DTOF system, and so would not be able to provide energy focussing of the ion beam at detector D.

This problem is overcome in an embodiment of a 2DTOF according to the present invention. In this embodiment, the 2DTOF is modified in such a way that time differences between ions due to field-free flight outside the system are corrected inside the system. In order to do this, the flight-direction, X-axis ion mirrors are optimised in such a way that the period T(K) of a single reflection in the flight direction is no longer independent of energy, as shown in FIG. 7, but has a small linear (and higher order) aberration. Such aberrations, when accumulated over several reflections, can be arranged to compensate for the time differences between ions having the same mass-to-charge ratio, but different energies, caused by their separation due to field-free flight outside the system, and so a higher order focus can be achieved at the detector. In this way, ions of higher energy which enter the 2DTOF ahead of less energetic ions can be arranged to leave the 2DTOF behind the less energetic ions so that all ions arrive at the detector at the same time regardless of their energies. Similarly, an energy-dependent reflection period T(K) may be used to cause ions of higher energy which enter the 2DTOF at the same time as less energetic ions, to leave the 2DTOF behind the less energetic ions so that, again, all the ions arrive at the detector at the same time regardless of their energies.

A second method of achieving an energy focus at the detector requires a different design of the ion source. In this case, an additional acceleration stage is introduced just after a first acceleration stage and before the first focus. Such a design could be used with the 3D ion trap source of FIG. 8 and with the LIT source of FIG. 9, but will be described here in combination with the axial ejection source of FIG. 10. As was described previously, additional acceleration is useful for reducing relative energy spread of the beam. Additional acceleration also changes the position of the first focus. When an extraction pulse is applied, ions which are positioned closer to the exit from the first acceleration stage are ejected first and have smaller energy because of the shorter acceleration distance. In a two stage acceleration source ions will be additionally accelerated by the second acceleration field. Due to this, separation along the flight path between ions of lower and higher energy increases and so it takes longer for the higher energy ions to catch up with the lower energy ions after they have left the second acceleration stage. As a result, the position of the first focus is shifted further away. The actual position of the first focus depends on the field strength and length of each stage and can be optimised for energy focusing at a required distance. A simulation shows that with first and second acceleration gaps of 10 mm and 50 mm respectively and field strengths of 96V/mm and 130V/mm respectively, the first focus occurs at a distance of 400 mm and may be arranged to coincide with the detector. Such a distance between the source and detector is sufficient to enable the ion beam to be diverted into the 2DTOF system as shown in FIG. 11B before it reaches the detector. In this case, diverting the beam into the 2DTOF system should not change the position of the focus and this requirement is fulfilled if the time of flight in the X direction is independent of ion longitudinal energy. This is because, as described earlier, in an optimised isochronous system time differences between ions having the same mass-to-charge ratio, but different energies, will remain unchanged by the system; that is, the time differences will be exactly the same when ions leave the system as when they entered the system and so will still come to a focus at the detector in the same way as if the 2DTOF system had been omitted. Of course, the separation of ions having different mass-to-charge ratios will increase because of the extended flight path within the system, giving improved mass resolution. As described earlier in relation to other embodiments of the invention, the isochronous property in the flight direction can be realised in many ways. One can optimise a system so that flight time of a single reflection in the X direction is independent of ion energy. In this case the system will have as many isochronous points as the number of reflections in the X direction and the beam will be compressed in space many times. It is also possible to optimise the ion mirrors in the X direction in such way that isochronous points occur after several reflections or even at the end of the complete trajectory. This kind of optimisation is preferable from the point of view of space-charge distortions, because in the latter case ion packets most of the time move in an uncompressed state. In the drift direction the Z beam should be refocused from the point of exit from deflector 402 to the point of entry to deflector 403. Flight times of ions in the drift direction between these two points should be substantially independent of drift energy. In practice, though high order focusing in the drift direction is not required. Loss of transmission does not occur as long as the ion beam is narrower than the width of detector D and resolving power of mass analysis is not affected by the beam width.

Figure 14:
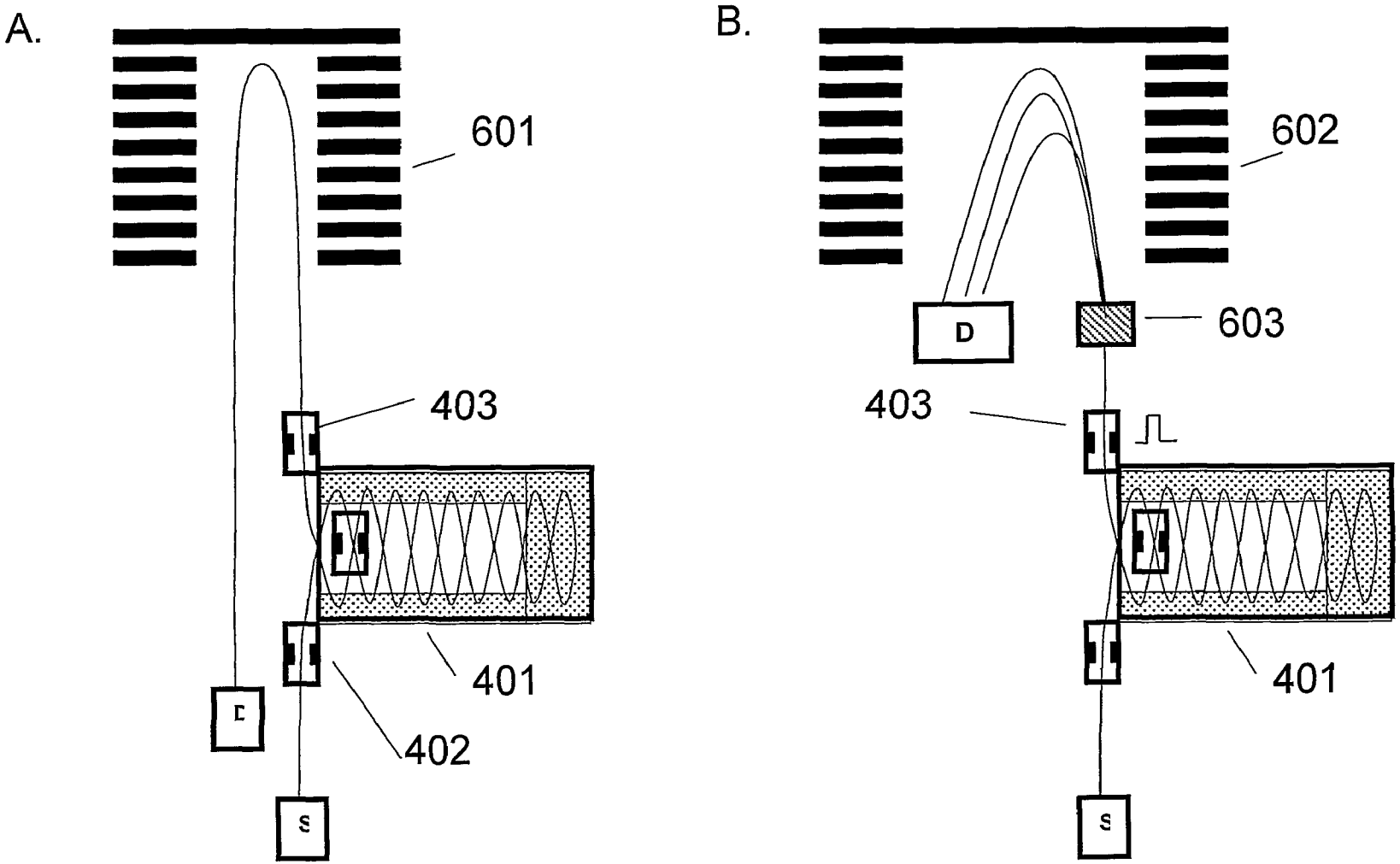

Due to the isochronous properties of the 2DTOF system it can be used in any conventional TOF system as a delay line in order to improve resolving power of mass analysis. FIG. 14.A shows an example of such a system. Conventional TOF systems include a source (S) and an ion mirror 601 which are constructed and optimised in such a way that ion packets of similar mass are focused (compressed in space) just before the surface of detector (D). This happens due to specific correlation between relative positions and longitudinal energies of ions of similar mass at any given time. A 2DTOF system according to the invention can be optimised in such way that the flight time in two directions (X and Z) is independent of ion energy within some range. Due to this property it is possible to place the 2DTOF system anywhere on the field-free flight path of the beam and use it as a delay line for ion packets. In FIG. 14.A 2DTOF system of invention 401 is placed on the field-free flight path of a beam between the ion source and the ion mirror 601. Deflector 402 directs the ion beam into the 2DTOF and the deflector 403 is used to direct the beam back into the flight path towards ion mirror 601. The spatial separation of ions having the same mass-to-charge ratio, but different energies, is the same when the ions leave the 2DTOF through deflector 403 as if the 2DTOF had been omitted altogether because the flight times of ions is increased by the same amount independently of their energies. Accordingly, the ion packets will be focused by the rest of a system at the surface of detector in just the same way as would happen without the 2DTOF, but ions having different mass-to-charge ratios will have increased separation in time due to the extended time-of-flight in the 2DTOF, resulting in a considerable improvement of mass resolving power.

Another application of a 2DTOF system is shown in FIG. 14.B. In this case it is used as a separation device for selection of ions. Due to the considerable time-of-flight difference in the 2DTOF, ions of different mass are separated in space after leaving 2DTOF. Deflector 403 is operated in a pulsed mode, transmitting ions only for a short time. By this means a mass range or sub ranges are selected with high resolving power. Downstream of 2DTOF there is a collision cell 603 for which a chamber with collision gas can be used. Gasses with high molecular mass such as Argon Krypton or Xenon are preferable. Selected ions are activated by collisions with buffer gas molecules and fragment. Fragments continue their way towards ion mirror 602 (in this case a reflectron) and are focused at the detector producing a mass spectrum of fragments for ion species selected in 2DTOF. Due to conservation laws fragments have almost the same velocity as the original parent ions and consequently have smaller energy. In this case, mirror 602 would need to be capable of focusing ions of widely different energies, thus mirrors having an almost parabolic potential distribution along the flight axis are preferable.

The described embodiments are presented by way of example; persons skilled in the art will appreciate that numerous changes can be made while staying within the scope of the accompanying claims.

The invention claimed is:

1. A multi-reflecting TOF mass analyser comprising electrostatic field generating means configured to define two, parallel, gridless ion mirrors each having an elongated structure in a drift direction, said ion mirrors providing a folded ion path formed by multiple reflections of ions in a flight direction, orthogonal to the drift direction, and displacement of ions in the drift direction, and being further configured to define a further gridless ion mirror for reflecting ions in said drift direction, whereby, in operation, ions are spatially separated according to mass-to-charge ratio due to their different flight times along the folded ion path and ions having substantially the same mass-to-charge ratio are subjected to energy focusing with respect to said flight direction and said drift direction.

2. A TOF mass analyser as claimed in claim 1 wherein said two, parallel, gridless ion mirrors each comprises a respective set of electrodes extending parallel to said drift direction and said further ion mirror comprises a further set of electrodes extending orthogonally to said drift direction, each said set of electrodes being symmetric with respect to the plane of said folded ion path.

3. A TOF mass analyser as claimed in claim 1 including directing means for directing ions onto said folded ion path.

4. A TOF mass analyser as claimed in claim 3 including directing means for directing ions from said folded ion path.

5. A TOF mass analyser as claimed in claim 3 wherein said directing means comprises deflector means.

6. A TOF mass analyser as claimed in claim 5 when said deflector means is electrostatically controllable to control an angle, relative to said flight direction, at which ions are directed onto said folded ion path.

7. A TOF mass analyser as claimed in claim 3 where said directing means comprises electrostatic sector field means.

8. A TOF mass analyser as claimed in claim 1 including electrostatically controllable deflector means located on said folded ion path for selectively reflecting ions back to said further ion mirror whereby said folded ion path has a looped configuration.

9. A TOF mass analyser as claimed in claim 8 wherein said electrostatically controllable deflector means located on said folded ion path is arranged selectively to cause repeated reflection of ions back to said further ion mirror.

10. A TOF mass analyser as claimed claim 1 including a said further ion mirror at each end of said elongated structure.

11. A TOF mass analyser as claimed in claim 10 including deflector means located between said further ion mirrors and arranged selectively to direct ions onto, or direct ions from said folded ion path.

12. A TOF mass analyser as claimed in claim 11 wherein said deflector means located between said further ion mirrors includes a first deflector for directing ions onto said folded ion path for reflection at a said further ion mirror and a second deflector for directing ions from said folded ion path following reflection at a said further mirror.

13. A TOF mass analyser as claimed in claim 1 wherein said energy focusing is such that the period of each reflection in the flight direction is dependent on ion energy.

14. A TOF mass spectrometer comprising an ion source for supplying ions, a TOF mass analyser as claimed in claim 1 for analyzing ions supplied by the ion source and a detector for receiving ions having the same mass-to-charge ratio and different energies at substantially the same time, after they have been separated according to mass-to-ratio by the TOF mass analyser.

15. A TOF mass spectrometer as claimed in claim 14 wherein said energy focusing in said TOF mass analyser is such that the period of each reflection in the flight direction is dependent on ion energy and is effective substantially to compensate for time differences between ions having the same mass-to-charge ratio and different energies due to their field-free flight outside the TOF mass analyser whereby to enable the ions to arrive at the detector at substantially the same time.

16. A TOF mass spectrometer as claimed in claim 15 where said compensation is such that ions entering the TOF mass analyser with successively decreasing energies exit the TOF mass analyser with successively increasing energies.

17. A TOF mass spectrometer as claimed in claim 14 wherein said energy focusing in said TOF mass analyser is such that the period of each reflection in the flight direction is independent of ion energy and said ion source is arranged to create an isochronous point at the detector for ions supplied by the ion source having the same mass-to-charge ratio and different energies.

18. A TOF mass spectrometer as claimed in claim 17 wherein said ion source comprises an ion storage device, means for ejecting ions from the ion storage device and means for accelerating the ejected ions to increase their energies whereby to reduce a relative energy spread of the ejected ions and create said isochronous point at the detector.

19. A TOF mass spectrometer as claimed in claim 14 including a further mass analyser positioned on a flight path between said TOF mass analyser and said detector, and wherein said energy focusing in said TOF mass analyser is such that the period of each reflection in the flight direction is independent of ion energy and said TOF mass analyser is effective to delay ions having the same mass-to-charge ratio and different energies by the same amount.

20. A TOF mass spectrometer as claimed in claim 19 including fragmentation means for fragmenting ions after being delayed by said TOF mass analyser and wherein the TOF mass analyser includes deflector means arranged to direct ions having a selected range of mass-to-charge ratio from said folded ion path to the fragmentation means.

* * * * *